US007244169B2

(12) United States Patent
Cyrille et al.

(10) Patent No.: US 7,244,169 B2
(45) Date of Patent: Jul. 17, 2007

(54) IN-LINE CONTIGUOUS RESISTIVE LAPPING GUIDE FOR MAGNETIC SENSORS

(75) Inventors: Marie-Claire Cyrille, San Jose, CA (US); Kuok San Ho, Santa Clara, CA (US); Tsann Lin, Saratoga, CA (US); Scott Arthur MacDonald, San Jose, CA (US); Huey-Ming Tzeng, San Jose, CA (US)

(73) Assignee: Hitachi Global Storage technologies Netherlands BV, Amsterdam (NL)

( * ) Notice: Subject to any disclaimer, the term of this patent is extended or adjusted under 35 U.S.C. 154(b) by 439 days.

(21) Appl. No.: 10/954,868

(22) Filed: Sep. 30, 2004

(65) Prior Publication Data

US 2006/0068685 A1 Mar. 30, 2006

(51) Int. Cl.
*B24B 49/00* (2006.01)
*B24B 51/00* (2006.01)
*G11B 5/42* (2006.01)

(52) U.S. Cl. ..... 451/8; 29/603.09; 29/603.16; 451/41

(58) Field of Classification Search ..... 29/593, 29/603.01, 603.07, 603.09, 603.1, 603.16; 451/5, 8, 9, 11; 360/122, 125–127
See application file for complete search history.

(56) References Cited

U.S. PATENT DOCUMENTS 5,755,612 A 5/1998 Schaenzer et al.
5,816,890 A 10/1998 Hao et al.
5,911,455 A * 6/1999 Draaisma et al. ..... 29/603.07
5,991,698 A 11/1999 Hao et al.
6,007,405 A * 12/1999 Mei ..... 451/5
6,193,584 B1 2/2001 Rudy et al.
6,219,205 B1 * 4/2001 Yuan et al. ..... 360/319
6,330,488 B1 12/2001 Yoshida et al.
6,370,763 B1 4/2002 Watanuki et al.
6,699,102 B2 3/2004 Reiley et al.
6,935,923 B2 * 8/2005 Burbank et al. ..... 451/5
6,997,784 B2 * 2/2006 Bunch et al. ..... 451/41
7,014,530 B2 * 3/2006 Kasiraj et al. ..... 451/8
7,062,838 B2 * 6/2006 Ding et al. ..... 29/603.12
2002/0173227 A1 11/2002 Lam et al.
2004/0009739 A1 1/2004 Zhu

* cited by examiner

*Primary Examiner*—Timothy V. Eley
(74) *Attorney, Agent, or Firm*—Bracewell & Giuliani LLP

(57) ABSTRACT

An in-line lapping guide uses a contiguous resistor in a cavity to separate a lithographically-defined sensor from the in-line lapping guide. As lapping proceeds through the cavity toward the sensor, the resistance across the sensor leads increases to a specific target, thereby indicating proximity to the sensor itself. The contiguous resistor is fabricated electrically in parallel to the sensor and the in-line lapping guide. The total resistance across the sensor leads show resistance change even when lapping through the cavity portion. One method to produce the contiguous resistor is to partial mill the cavity between the sensor and the in-line lapping guide so that a film of metal is left. Total resistance across leads is the parallel resistance of the sensor, the contiguous resistor, and the in-line lapping guide.

11 Claims, 4 Drawing Sheets

IN-LINE CONTIGUOUS RESISTIVE LAPPING GUIDE FOR MAGNETIC SENSORS

BACKGROUND OF THE INVENTION

1. Technical Field

The present invention relates in general to fabricating magnetic sensors and, in particular, to an improved system, method, and apparatus for in-line contiguous resistive lapping of magnetic sensors.

2. Description of the Related Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface (ABS). Large numbers of sliders are fabricated from a single wafer having rows of the magnetic transducers deposited simultaneously on the wafer surface using semi-lead-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The magnetic head is typically an inductive electromagnetic device including magnetic pole pieces, which read the data from or write the data onto the recording media surface. In other applications the magnetic head may include a magneto resistive read element for separately reading the recorded data with the inductive heads serving only to write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. Each head has a polished ABS with flatness parameters, such as crown, camber, and twist. The ABS allows the head to "fly" above the surface of its respective spinning disk. In order to achieve the desired fly height, fly height variance, take-off speed, and other aerodynamic characteristics, the flatness parameters of the ABS need to be tightly controlled. During manufacturing, it is most critical to grind or lap these elements to very close tolerances of desired flatness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider ABS.

In magnetic head applications, the electrically active components exposed at the ABS are made of relatively softer, ductile materials. These electrically active components during lapping can scratch and smear into the other components causing electrical shorts and degraded head performance. The prior art lapping processes cause different materials exposed at the slider ABS to lap to different depths, resulting in recession or protrusion of the critical head elements relative to the air bearing surface. As a result, poor head performance because of increased space between the critical elements and the recording disc can occur.

Rotating lapping plates having horizontal lapping surfaces in which abrasive particles such as diamond fragments are embedded have been used for lapping and polishing purposes in the high precision lapping of magnetic transducer heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor element heights needed for magnetic recording.

However, if the components used to lap the heads make contact with the sensors, they will cause lapping-induced stress. Lapping-induced stress causes sensor response to degrade. Traditionally, the potential damage done by lapping-induced stress has been mitigated by offsetting the read element from the ABS surface so that the lapping components do not contact or stress the sensors. In some cases, the read elements are recessed from the ABS surface by a distance in the range of 50 to 125 nm. Unfortunately, such large distances between the sensor and the magnetic surface cause unacceptable signal loss in modern read sensors. Thus, an improved solution for mitigating the damage done by lapping-induced stress is needed.

Controlling the lapping of embedded sensors requires knowledge of the position of the lapping surface relative to the target plane. Such knowledge is typically provided by the resistance of the sensor during lapping. For the embedded sensor, the sensor resistance changes little when lapping in the cavity region. It is desirable to have additional information about the lapping surface position for the cavity region for the lapping of embedded sensors.

SUMMARY OF THE INVENTION

In one embodiment of a system, method, and apparatus of the present invention provides an in-line lapping guide that uses a contiguous resistor in a cavity to separate a lithographically-defined sensor from the in-line lapping guide. As lapping proceeds through the cavity toward the sensor, the resistance across the sensor leads increases to a specific target, thereby indicating proximity to the sensor itself.

The contiguous resistor is in the general form of a sheet of material that connects the sensor, leads, and the in-line lapping guide with a thickness that is significantly thinner than the sensor stack. It is configured electrically in parallel to the sensor and the in-line lapping guide. The total resistance across the sensor leads show resistance change even when lapping through the cavity portion. Without the contiguous resistor, the combined resistance across the leads shows little change when lapping through the cavity. Thus, with conventional methods, it is impossible to know the relative position of the lapping surface through the cavity. However, with the contiguous resistor, the combined resistance across the leads exhibits nearly linear change with lapping. Such a linear change of resistance with time allows an easy determination of length of cavity material removed by lapping. The position of the lapping surface relative to the sensor is calculated by subtracting the cavity length removed by lapping from the initial cavity length, which is known from the fabrication steps.

One method to produce the contiguous resistor is to partial mill the cavity between the sensor and the in-line lapping guide so that a film of metal is left. Previous ion mill processes had shown that the thickness of the contiguous resistor film depends on, among several parameters, the cavity length for the same ion mill condition. Total resistance across leads is the parallel resistance of the sensor, the contiguous resistor, and the in-line lapping guide.

In one embodiment, the contiguous resistor is made of a sensor seedlayer and a small portion of the sensor stack, while the sensor stripe height is still well defined (i.e., straight wall profiles). The cavity length (i.e., length of the resistor) may range from about 50 to 1000 nm. The resistor has a total thickness of about 5% to 30% of the sensor stack. Various parameters may be changed to affect the desired result, such as material selection, resistivity, shape (i.e., length, width, thickness, and angle), and partial ion mill time.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
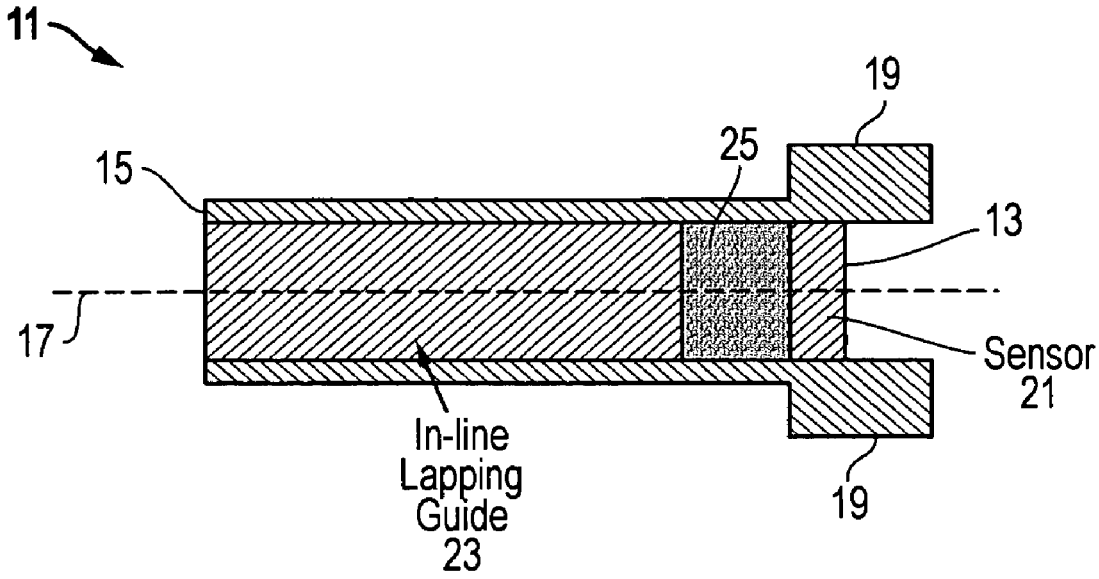
FIG. 1 is a top view of one embodiment of a structure constructed in accordance with the present invention and is shown prior to lapping.
Figure 2:
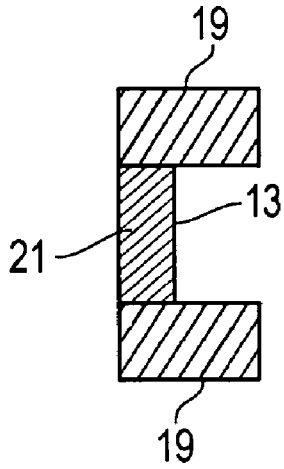
FIG. 2 is a top view of the structure of FIG. 1, but is shown after lapping.
Figure 3:
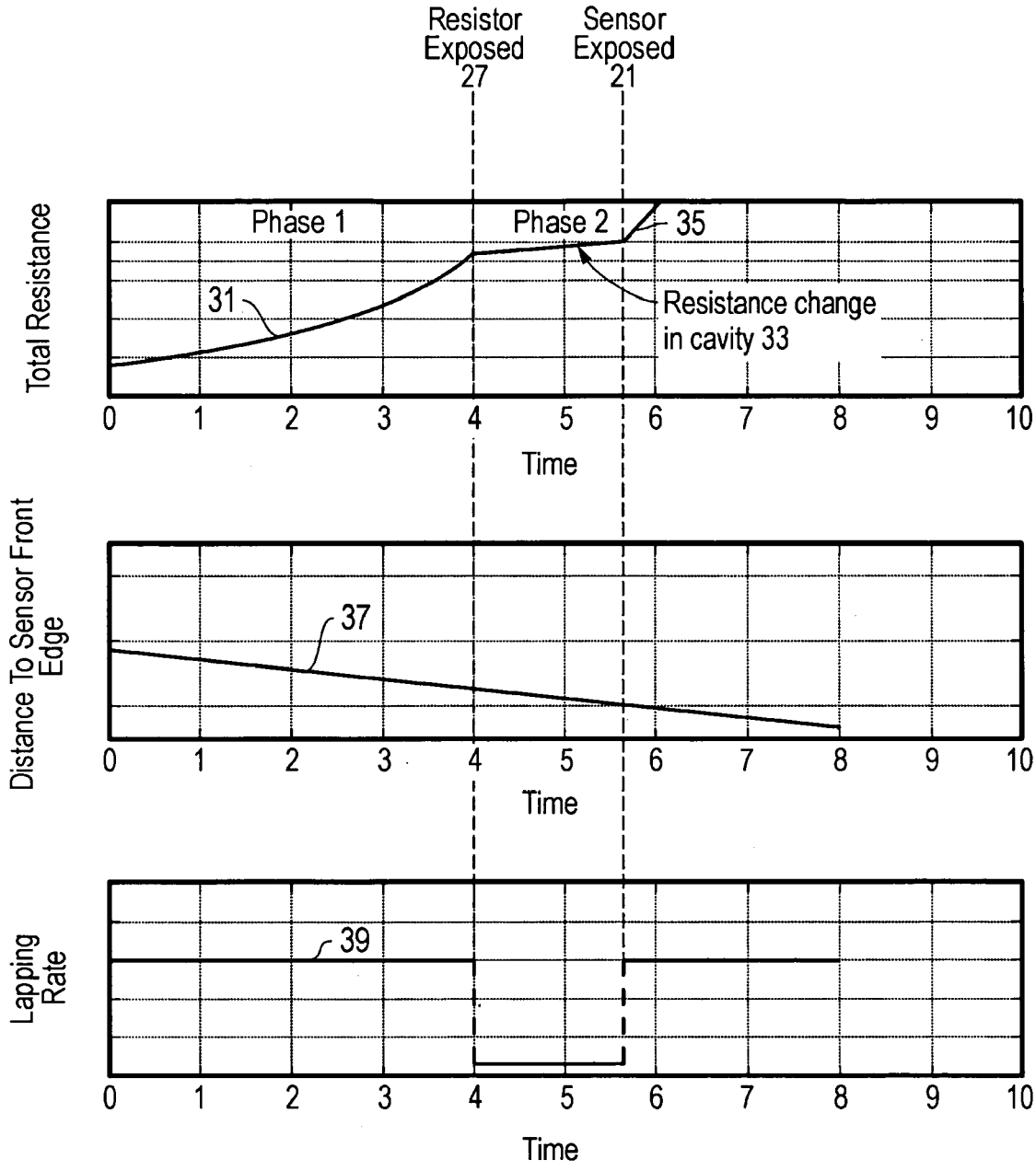
FIG. 3 is a plot of the performance of a sample of the structures of FIG. 1.

Referring to FIGS. 1-6, one embodiment of a system, method, and apparatus for providing an in-line contiguous resistive lapping guide is disclosed. The present invention comprises a structure 11 (FIG. 1 and shown in the left half of a symmetrical structure in FIG. 6) having a proximal end 13, a distal end 15, and an axis 17 extending therebetween to define an axial direction. A pair of electrical leads 19 extends in the axial direction from the proximal end 13 to the distal end 15.

A sensor 21 is embedded in the structure 11 on the proximal end 13 between the electrical leads 19. The structure 11 and sensor 21 may be formed by several different methods, including lithography. In one embodiment, the sensor 21 is lithographically formed. An in-line lapping guide 23 is mounted to the structure 11 adjacent the distal end 15 between the hard-bias 29, which is covered by the electrical leads 19 and extends in the axial direction. A cavity 25 is located between the sensor 21 and the in-line lapping guide 23 and has a resistor 27 that extends in the axial direction from in-line lapping guide 23 to sensor 21. The cavity 25 around the resistor 27 is filled with a non-conducting material (such as a dielectric material) as shown.

The structure 11 is lapped in the axial direction 17 (e.g., from left to right) from the in-line lapping guide 23 and through the resistor 27 to give an indication of a position of the sensor 21 via electrical resistance measurements between the electrical leads 19. For example, as illustrated in the uppermost plot of FIG. 3, the in-line lapping guide 23 (Phase 1) and the resistor 27 (Phase 2) each has an electrical resistance 31, 33, respectively, that increases when lapped in the axial direction (e.g., from left to right). The middle plot 37 in FIG. 3 (which is functionally aligned with the two lower plots) illustrates a distance from sensor 21 during lapping, while the lowermost plot 39 depicts lapping rate during the same operation.

In the embodiment shown, the lead-to-lead resistance 33 of the sensor 21 and resistor 27 increases linearly when resistor 27 is lapped. However, the sensor 21 has an electrical resistance 35 that increases more rapidly when lapped in the axial direction. In one embodiment, the sudden increase in electrical resistance 35 of the sensor 21 is detected (due to the removal of the more highly resistive cavity 25 and resistor 27), and lapping is terminated before any significant portion of sensor 21 is lapped.

Figure 6:
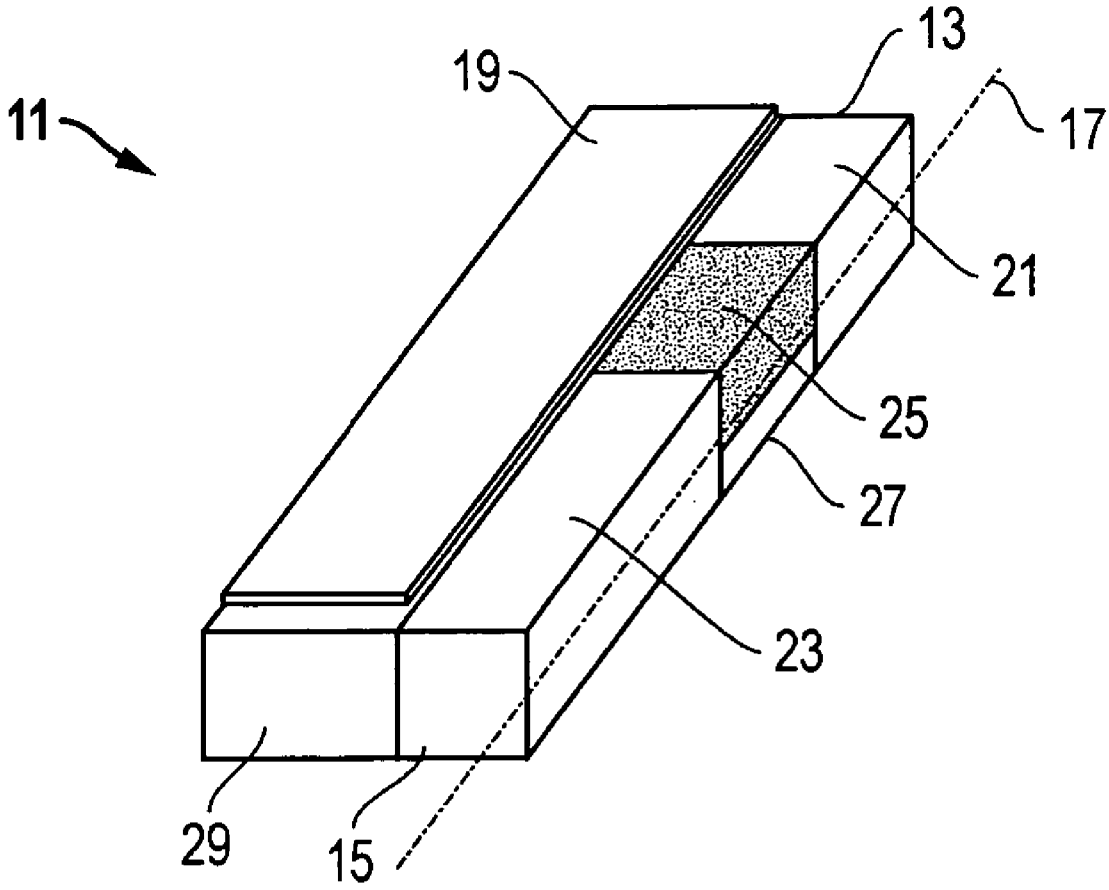
FIG. 6 is an isometric view of a left half of the structure of FIG. 1 and is constructed in accordance with the present invention.

In the configurations of FIGS. 1 and 6, the resistor 27 is electrically in parallel to the sensor 21 and the in-line lapping guide 23. As stated above, the resistor 27 has an electrical resistance 33 that is greater than the electrical resistance 35 of the sensor 21 when lapped. The exposure of the resistor 27 and the sensor 21 can be detected by noting the rapid decrease and increase, respectively, in the lapping rate. An integration of the rate data with respect to time yields information about the length lapped from the cavity. The distance of the lapping surface to the front edge of the sensor is the difference of the cavity length and the amount of cavity length lapped. Such distance information can be used to predict the exposure of the sensor. It can be used to change the lapping parameters to optimized sensor response.

In one embodiment, the cavity 25 is partially ion milled to form the resistor 27 as a film of metal. In some versions, this may comprises reducing a thickness of the cavity 25 to about 5% to 30% of its original thickness that is transverse (e.g., vertical) to axial direction 17. The electrical resistance 33 of the cavity 25 and resistor 27 may be altered by changing a geometry of the cavity 25 and resistor 27, such as length, width, depth, shape, angle of inclination, etc. In addition, the electrical resistance 33 of the resistor 27 may be altered by changing a material of the resistor 27 to other substances, alloys, etc.

Figure 4:
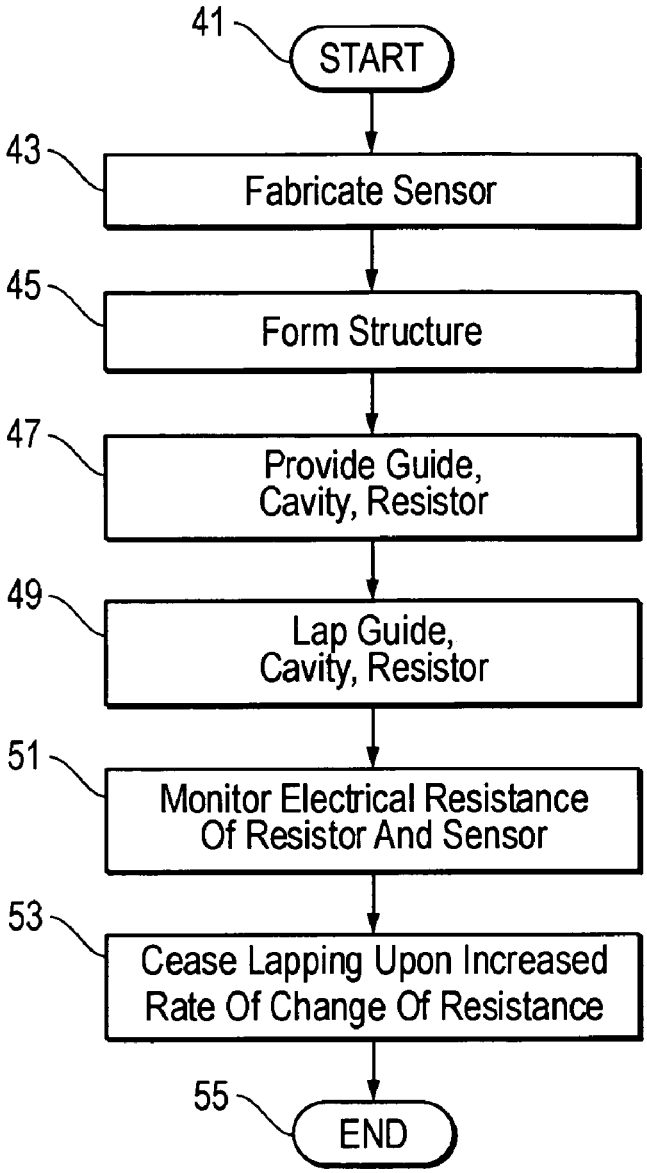
FIG. 4 is a flowchart of one embodiment of a method constructed in accordance with the present invention.

Referring now to FIG. 4, the present invention also comprises a method of providing an in-line contiguous resistive lapping guide for a structure. The method starts at step 41 by fabricating a sensor 21 (step 43) with an axial direction or a magnetic path direction 17, and forming the sensor 21 (step 45) in a structure 11 having conductive leads 19 that extend in the magnetic path direction 17 from the sensor 21. As indicated at step 47, the method also comprises providing an in-line lapping guide 23 in the structure 11 that extends in the magnetic path direction 17, and a cavity 25 containing a material between the in-line lapping guide 23 and the sensor 21 such that the sensor 21 is embedded in the structure 11.

The method further comprises positioning a resistor 27 (step 47) in the cavity 25 between the sensor 21 and the in-line lapping guide 23, such that a total resistance across the conductive leads 19 is the parallel resistance of the sensor 21, the resistor 27, and the in-line lapping guide 23. In addition, the method comprises lapping the in-line lapping guide 23 and the cavity material 25 and resistor 27 (step 49) in the magnetic path direction 17 and monitoring an electrical resistance 33 of the cavity 25 (step 51) via the conductive leads 19, and determining a lapping end point at the sensor 21 (step 53) based on a change in electrical resistance between the conductive leads 19, before ending at step 55.

Moreover, the resistance change when lapping through resistor 27 allows a determination of the distance from the lapping surface to the front edge of the sensor 21 so that lapping conditions can be changed to optimize the sensor output. The method also may comprise partial ion milling the cavity 25 to form the resistor 27 as a film of metal. In addition, the method may comprise altering the electrical resistance 33 of the cavity 25 and resistor 27 by changing a geometry thereof, or by changing a material of the resistor 27 and/or cavity 25.

Figure 5:
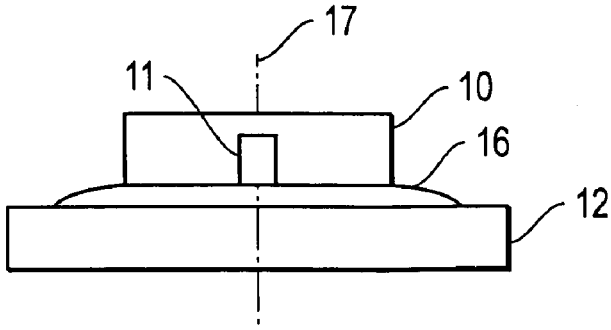
FIG. 5 is a schematic diagram of a lapping device for lapping the structure of FIG. 1 and is constructed in accordance with the present invention.

Referring now to FIG. 5, the present invention may be utilized in a lapping device such as the one illustrated. The 1 lapping device includes a lapping instrument 12 that laps a workpiece 10 containing or supporting the previously described structure 11, and may incorporate a lubricant or slurry 16. The axial direction of the sensor structure 17 is perpendicular to the lapping surface of the lapping instrument 12.

While the invention has been shown or described in only some of its forms, it should be apparent to those skilled in the art that it is not so limited, but is susceptible to various changes without departing from the scope of the invention.

What is claimed is:

1. A method of providing an in-line contiguous resistive lapping guide, the method comprising:

(a) fabricating a sensor with a magnetic path direction;

(b) forming the sensor in a structure having conductive leads that extend in the magnetic path direction from the sensor;

(c) providing an in-line lapping guide in the structure that extends in the magnetic path direction, and a cavity containing a material between the in-line lapping guide and the sensor such that the sensor is embedded in the structure;

(d) positioning a resistor in the cavity between the sensor and the in-line lapping guide, such that a total resistance across the conductive leads is the parallel resistance of the sensor, the resistor, and the in-line lapping guide;

(e) lapping the in-line lapping guide and the cavity material and resistor in the magnetic path direction and monitoring an electrical resistance of the cavity via the conductive leads;

(f) determining a lapping end point at the sensor based on a change in electrical resistance between the conductive leads.

2. The method of claim 1, wherein the in-line lapping guide, the resistor, and the sensor each have an electrical resistance that, when lapped, increases, and the electrical resistance of the resistor is greater than that of either the in-line lapping guide or the sensor.

3. The method of claim 1, wherein step (f) comprises complete removal of the cavity material and resistor by lapping.

4. The method of claim 1, wherein steps (a) and (b) comprise lithographically pre-forming the sensor and the structure.

5. The method of claim 1, further comprising partially ion milling the cavity to form the resistor as a film of metal.

6. The method of claim 1, further comprising altering the electrical resistance of the cavity and resistor by changing a geometry of the cavity and resistor.

7. The method of claim 1, further comprising altering the electrical resistance of the resistor by changing a material of the resistor.

8. A method of providing an in-line contiguous resistive lapping guide, the method comprising:

(a) lithographically forming a sensor in a structure having a magnetic path direction and conductive leads that extend in the magnetic path direction from the sensor;

(b) providing an in-line lapping guide in the structure that extends in the magnetic path direction, and a cavity containing a material between the in-line lapping guide and the sensor such that the sensor is embedded in the structure;

(c) positioning a resistor in the cavity between the sensor and the in-line lapping guide, such that a total resistance across the conductive leads is the parallel resistance of the sensor, the resistor, and the in-line lapping guide;

(d) lapping the in-line lapping guide and the cavity material and resistor in the magnetic path direction and monitoring an electrical resistance of the resistor via the conductive leads;

(e) determining a lapping end point at the sensor based on a change in the electrical resistance of the resistor, which increases at a rate that is less than a rate of increase of electrical resistance for the sensor, such that the resistor is completely removed from the structure by lapping.

9. The method of claim 8, further comprising partially ion milling the cavity to form the resistor as a film of metal.

10. The method of claim 8, further comprising altering the electrical resistance of the cavity and resistor by changing a geometry of the cavity and resistor.

11. The method of claim 8, further comprising altering the electrical resistance of the resistor by changing a material of the resistor.

* * * * *